US005390831A

United States Patent [19]

Schneider

[11] Patent Number: 5,390,831

[45] Date of Patent: Feb. 21, 1995

[54] DISPENSING DEVICES FOR HIGH VISCOSITY COMPOSITIONS

[75] Inventor: Mark C. Schneider, Riverton, N.J.

[73] Assignee: Albion Engineering Company, Philadelphia, Pa.

[21] Appl. No.: 162,561

[22] Filed: Dec. 6, 1993

[51] Int. Cl.[6] ..... B67D 5/42

[52] U.S. Cl. ..... 222/391; 222/137; 74/141.5

[58] Field of Search ..... 222/391, 386, 327, 390, 222/137; 74/141.5, 520; 188/67

[56] References Cited

U.S. PATENT DOCUMENTS

| | | | |
|---|---|---|---|
| 1,238,733 | 9/1917 | Arden . | |
| 2,138,045 | 11/1938 | Seeberger . | |
| 2,731,176 | 1/1956 | Crew | 222/326 |
| 3,029,653 | 4/1962 | Nilsson | 74/169 |
| 4,009,804 | 1/1977 | Costa | 222/391 |
| 4,081,112 | 3/1978 | Chang | 222/391 |
| 4,289,257 | 9/1981 | Herb | 222/146 |
| 4,461,407 | 7/1984 | Finnegan | 222/391 |
| 4,471,888 | 9/1984 | Herb | 222/137 |
| 4,509,662 | 4/1985 | Weiss | 222/391 |
| 4,566,610 | 1/1986 | Herb | 222/137 |
| 4,570,842 | 2/1986 | Gregorious | 228/48 |
| 4,641,766 | 2/1987 | Vlasich | 222/391 |
| 4,681,524 | 7/1987 | Ikeda | 425/376 |
| 5,052,243 | 10/1991 | Tepic | 222/391 X |
| 5,197,635 | 3/1993 | Chang | 222/137 |
| 5,211,312 | 5/1993 | Chang | 222/153 |
| 5,323,931 | 6/1994 | Robards, Jr. et al. | 222/391 X |

*Primary Examiner*—Gregory L. Huson
*Attorney, Agent, or Firm*—Caesar, Rivise, Bernstein, Cohen & Pokotilow, Ltd.

[57] ABSTRACT

Dispensing device for high viscosity compositions includes an elongate drive rod movable in a linear direction for dispensing a high viscosity composition; a driving grip for receiving the drive rod therethrough and for engaging and driving the drive rod in the linear direction; a trigger pivotally secured to an axle and including a hand gripping section for actuating the trigger and a first link section; a second link pivotally secured to the first link section of the trigger through a toggle axle spaced from the axle of the trigger, whereby the second link and the first link section are movable from a first, retracted condition prior to manual actuation of the trigger to a second, extended condition upon manual actuation of the trigger to impart a high thrust to the second link. The second link is operably connected to a force transmitting member engaging the driving grip whereby the high thrust is imparted to the force transmitting member and the driving grip.

13 Claims, 5 Drawing Sheets

FIG. 2
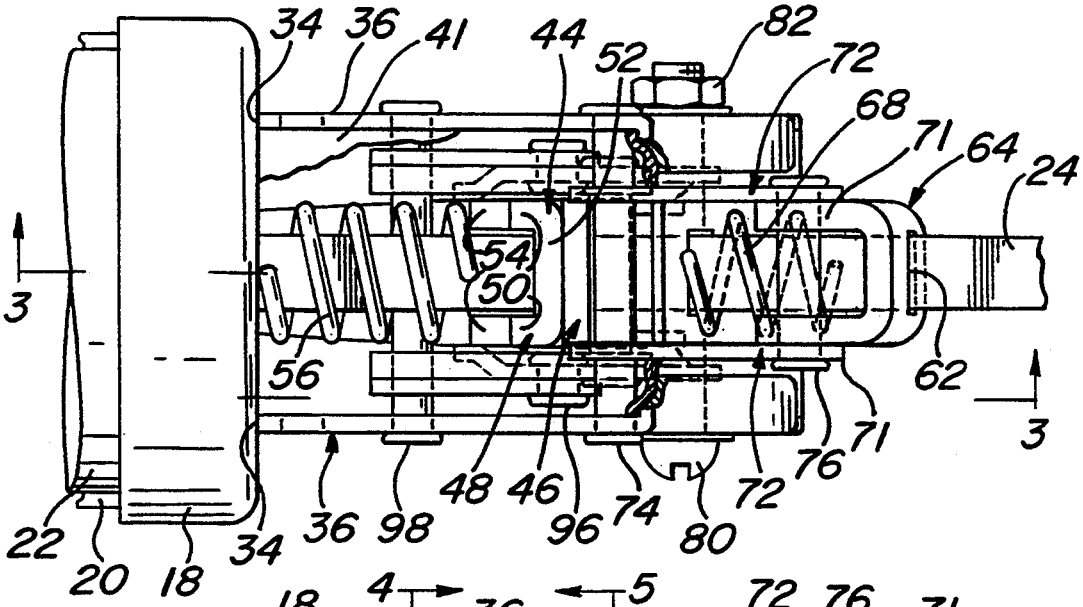
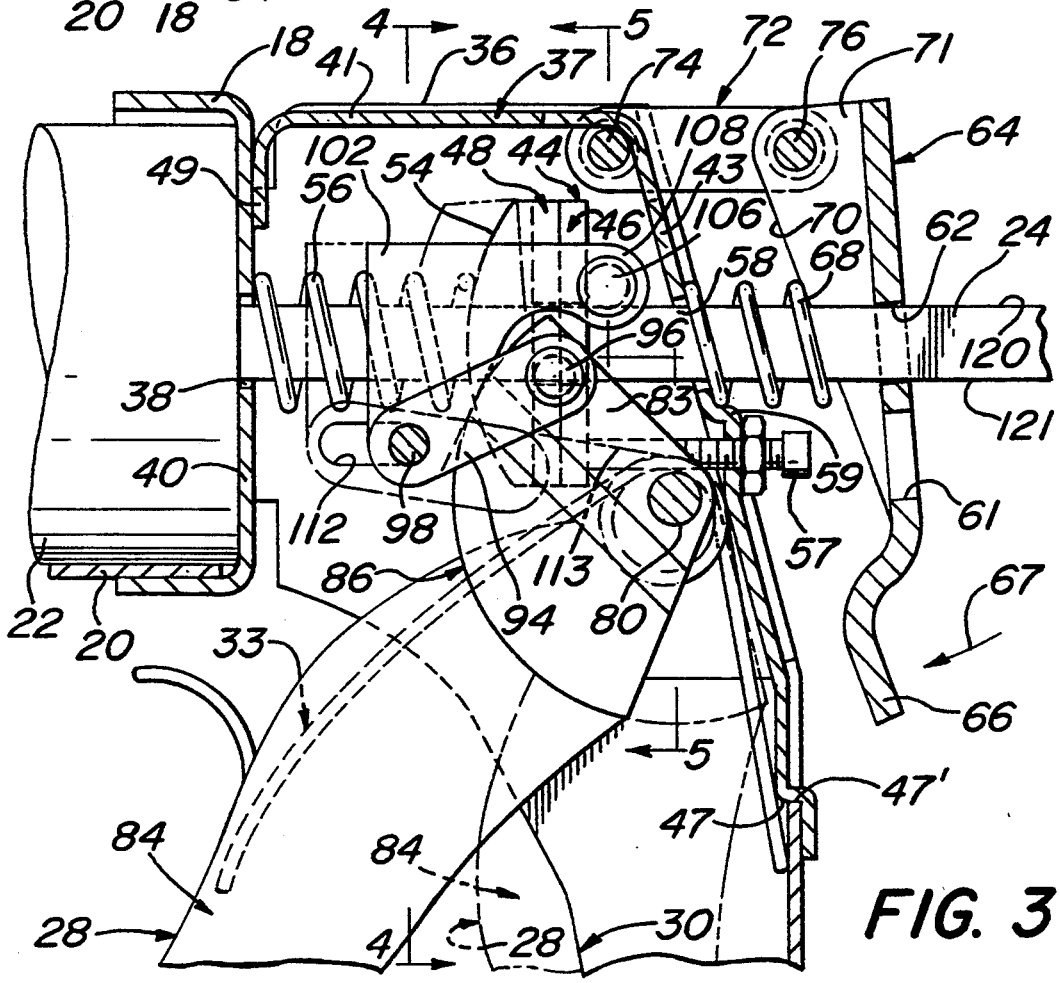
FIG. 3

FIG. 4
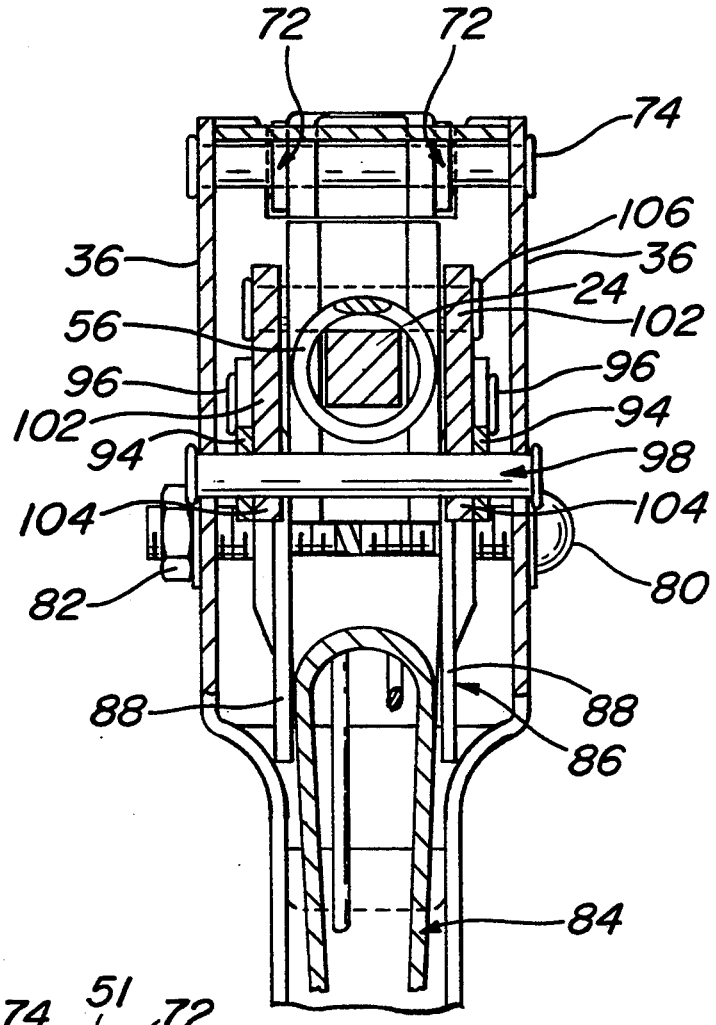
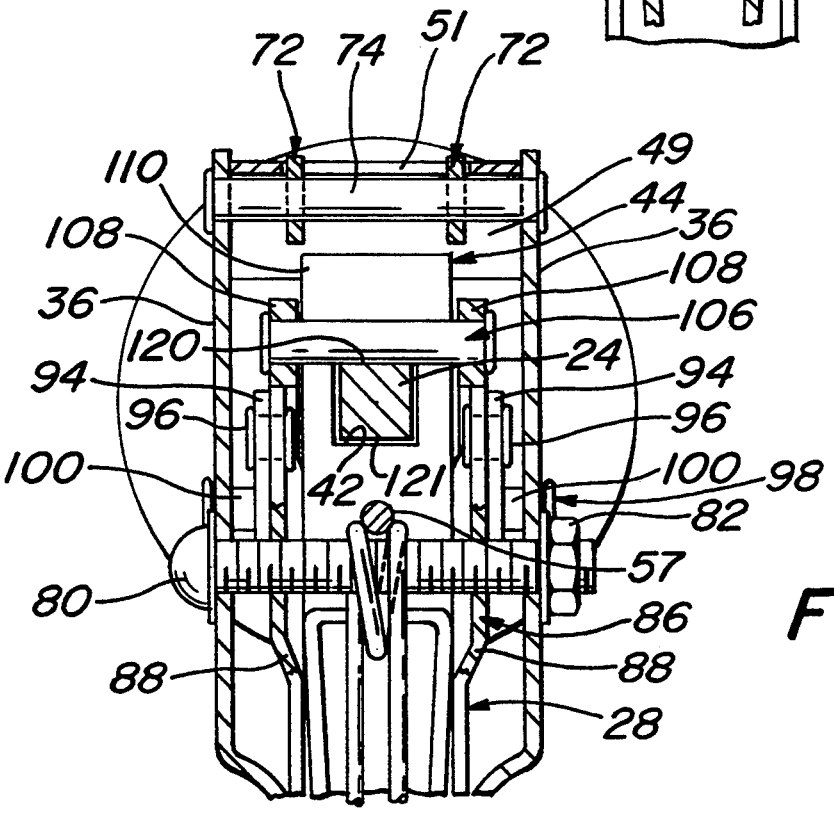
FIG. 5

DISPENSING DEVICES FOR HIGH VISCOSITY COMPOSITIONS

BACKGROUND OF THE INVENTION

This invention relates generally to dispensing devices, and more specifically to dispensing devices for high viscosity compositions, such as caulking materials, grease, automotive windshield sealant, dual component reactive resins, and the like.

Dispensing devices for high viscosity compositions are well known in the art and employ a variety of dispensing drive systems.

A number of patents disclose drive systems wherein a trigger includes a drive dog as an integral part thereof, or includes a drive member directly connected thereto, for directly engaging and actuating a driving grip through which a drive rod extends. Representative patents disclosing these types of arrangements are U.S. Pat. Nos. 5,197,635 (Chang); 4,681,524 (Ikeda, et al.); 4,509,662 (Weiss); 4,461,407 (Finnegan); 4,081,112 (Chang); 4,009,804 (Costa, et al.); 2,731,176 (Crewe) and 1,231,733 (Arden).

U.S. Pat. No. 4,641,766, issued to Vlasich, discloses an arrangement for dispensing high viscosity compositions, wherein a piston 16 is slidable within a chamber 14 containing the composition to be dispensed, and a plunger rod 18 connected to the piston has spaced disc-shaped projections thereon. The spaces between the projections are engaged by diametrically opposed teeth 27 forming part of diametrically opposed, manually actuatable arms 25*a* and 25*b* for feeding the piston 16 in a composition-dispensing direction.

U.S. Pat. No. 3,029,653, issued to Nilsson, discloses a dispensing device in which either a downwardly extending dog 29 or an upwardly extending dog 30 is employed to engage with rachet teeth 31 of a piston rod 18 and thereby move the piston rod for dispensing a caulking composition. To effect movement of the piston rod 18 a link member 23 is rotatably secured at one end to a manually actuatable trigger 26 by a pivot pin 25, and at its opposite end to a lower end of an operating lever 21 carrying the dogs 29 and 30. The operating lever 21 is pivotally mounted adjacent an upper end thereof to a pivot pin 22, and is pivotally joined to the link member 23 through a pivot pin 24. As is best seen in FIG. 4, it appears that the angular orientation between the link member 23 and the operating lever 21 remains substantially the same both prior to and after actuation of the trigger 26 to cause either the upper dog 29 or the lower dog 30 to cooperate with rachet teeth 31 in feeding the piston rod 18 in a composition-dispensing direction.

U.S. Pat. No. 2,138,045, issued to Seeberger, discloses a rachet driving mechanism for a driving rod 11 employing a fairly complex arrangement of links for operating a power-applying member 12 for moving the piston rod 11. Specifically, the power-applying member 12 is operatively connected to a trigger lever 13 by a toggle mechanism including the several links 14, 15 and 16; with one end of the link 14 being pivotally connected at 14*a* to the trigger lever 13 and the opposite end of said link being connected at 14*b* to the links 15 and 16. In addition to the fairly complex linkage system employed for driving the rod 11, the Seeberger system also includes a fairly complex arrangement for preventing undesired retraction of the rod 11. This arrangement includes a detent 18 slidably mounted in cam members 20 which, in turn, are manually controlled by the operation of a lever 25.

U.S. Pat. No. 4,566,610, issued to Herb, discloses an exemplary embodiment of a hand-held dispensing device for multi-component guns. In this latter device a pair of piston rods 8 and 9 are positively driven by a driving device 14 that is pulled forwardly by a link 13 interconnected to the driving device 14 and to a hand-operated lever 10.

The prior art devices, while generally usable for their intended purpose, either do not provide a sufficiently high thrust for permitting easy dispensing of very high viscosity compositions, and/or are undesirably complex in construction.

OBJECTS OF THE INVENTION

It is a general object of this invention to provide dispensing devices for high viscosity fluids, which overcome the deficiencies of the aforementioned prior art devices.

It is a further object of this invention to provide dispensing devices for high viscosity fluids, which are simple in construction and reliable in operation.

It is a further object of this invention to provide dispensing devices for high viscosity fluids including a driving system for establishing a high thrust for reliably dispensing such compositions.

It is a further object of this invention to provide a compact and reliable driving system for establishing a high thrust for the dispensing of high viscosity compositions.

It is a further object of this invention to provide a dispensing device employing a driving system that, during the dispensing operation, establishes an increasing fluid-dispensing thrust without sacrificing desired displacement of the dispensing mechanism.

It is yet a further object of this invention to provide a driving system for dispensing fluid in a trigger-actuated device, wherein the thrust applied to the driving system is effected by both the length and location of the stroke of the trigger.

SUMMARY OF THE INVENTION

The above and other objects of this invention are achieved in a dispensing device employing an elongate drive rod movable in a linear direction for dispensing the composition. The device includes a driving grip including a passage therethrough with the elongate drive rod extending through the passage in close conformity with surfaces defining the passage. A trigger is pivotally secured to an axle and includes a hand gripping section for actuating the trigger and a first link section. The hand gripping section and the first link section are integrally joined to move as a single unit about the axle, and a second link is pivotally secured to the first link section through a toggle axle that is spaced from the axle of the trigger. The second link and first link section are movable from a first, retracted condition prior to manual actuation of the trigger to a second, extended condition upon manual actuation of the trigger to provide a high thrust to the second link. A force transmitting member engages the driving grip and means operably connects the second link to the force transmitting member for imparting the high thrust from the second link to the force transmitting member and to the driving grip engaged by said force transmitting member.

In a preferred embodiment of the invention the means operably connecting the second link to the force transmitting member includes an intermediate drive member spaced from the toggle axle and operably connected to the second link and to a force transmitting system for transmitting a high thrust driving force from the second link to the force transmitting system and to the force transmitting member operably connected to the force transmitting system.

In the preferred form of the invention the elongate drive rod includes substantially smooth surfaces engageable by the driving grip for advancing the drive rod in the linear direction for dispensing the composition. In other words, the drive rod does not include any rachet teeth or similar abutments for use in moving the drive rod.

In the preferred form of the invention the drive rod includes a distal end on the distal side of the driving grip adjacent the composition to be dispensed and a proximal end on the opposite, proximal side of the driving grip, said intermediate drive member being located on the distal side of the driving grip and the force transmitting drive member being located on the proximal side of the driving grip. This provides for an extremely compact arrangement for transmitting the high thrust force from the toggle linkage to the driving grip.

In the most preferred embodiment of this invention the intermediate drive member is an elongate rod extending transversely to the elongate direction of the drive rod and includes opposed ends constrained for movement within guide slots that are elongated in a direction substantially parallel to the elongate direction of the drive rod. The intermediate drive member is movable within said elongate guide slots when the second link and first link section move relative to each other between the retracted and extended conditions. This arrangement provides controlled movement of the toggle links to provide an enhanced driving thrust to the force transmitting member located proximally of the driving grip. Most preferably, the intermediate drive member is located below the drive rod distally of the driving grip and the force transmitting member is located above the drive rod proximally of the driving grip.

BRIEF DESCRIPTION OF THE DRAWINGS

The above and other objects of this invention will become readily apparent from the detailed description which follows, when taken in conjunction with the accompanying drawings, wherein:

FIG. 2 is a plan view taken along line 2—2 of FIG. 1 with part of the housing broken away to show internal details of construction;

FIG. 3 is a sectional view taken along the stepped line 3—3 FIG. 2;

FIG. 4 is a sectional view taken along line 4—4 of FIG. 3;

FIG. 5 is a sectional view taken along the stepped line 5—5 of FIG. 3;

DESCRIPTION OF THE PREFERRED EMBODIMENTS OF THE INVENTION

Figure 1:
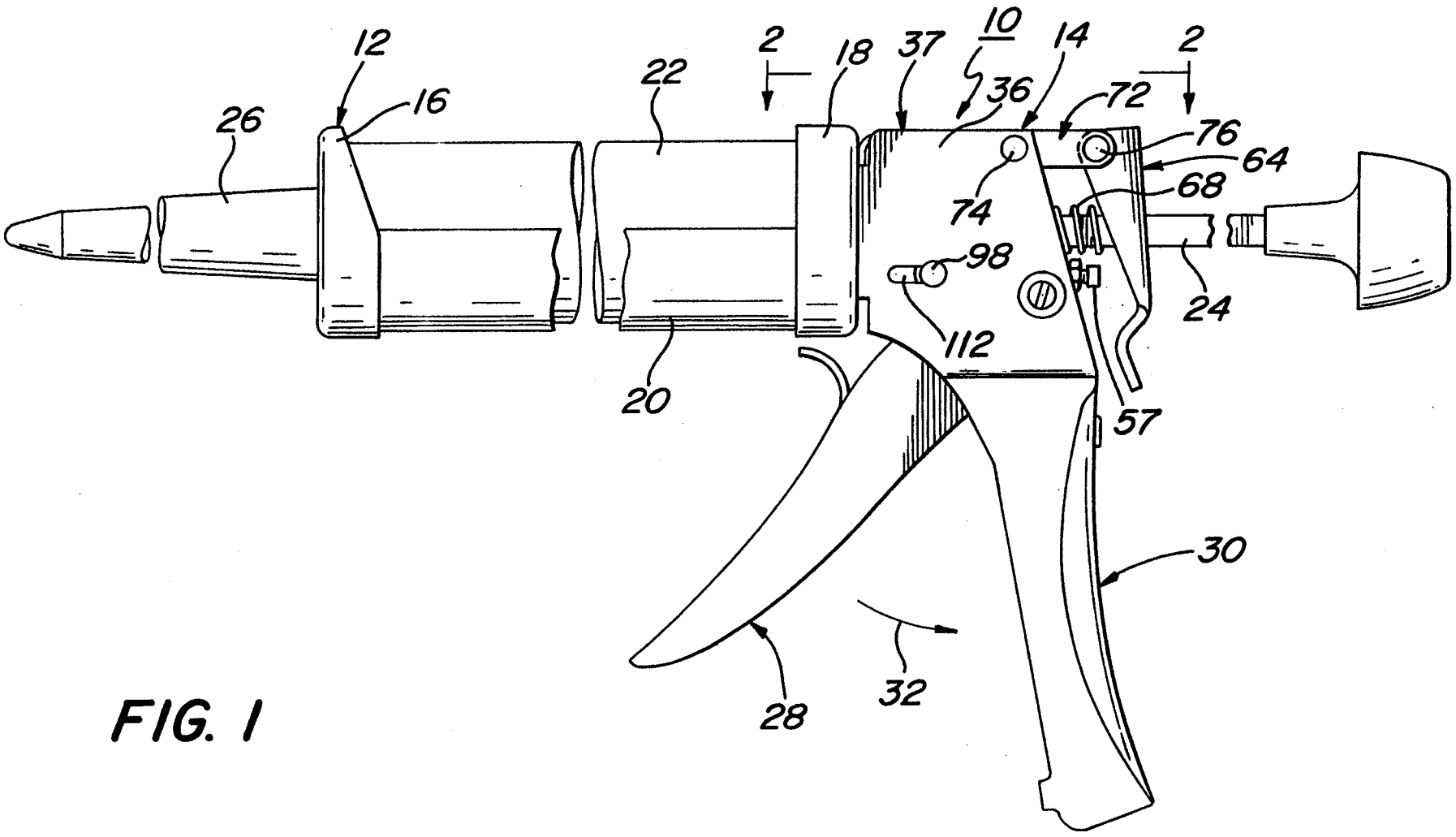
FIG. 1 is a fragmentary side elevational view of a dispensing device in accordance with this invention.

Referring now to the drawings, a gun for dispensing high viscosity fluids embodying the present invention is shown generally at 10 in FIG. 1. The dispensing device 10 includes a forward section 12 of conventional design for housing the composition to be dispensed, and a rearward driving section 14 employing a unique, high thrust driving system in accordance with the present invention.

It should be understood that the forward section 12 can be of any desired construction for housing a high viscosity composition to be dispensed, and does not constitute a limitation on the present invention. For example, although the embodiment chosen for illustration herein includes the high viscosity composition in a single disposable and replaceable hard cartridge or container 22, the dispensing devices of this invention can also include a fixed and permanent housing for receiving material to be dispensed that initially is packaged in bulk form, or for receiving material to be dispensed from a flexible, sausage-type cartridge. Moreover, all of these latter-mentioned options (i.e., hard cartridge, bulk form and sausage-type cartridge) can be employed in dual component dispensing devices as well as in single component dispensing devices. It also should be understood that the benefits achieved with the device of this invention are most pronounced when dispensing extremely high viscosity materials, such as caulking compositions, grease, automotive windshield sealants, dual component reactive resins, and other high viscosity compositions.

Still referring to FIG. 1, the forward section 12 in the embodiment chosen for illustration herein includes opposed distal and proximal end caps 16 and 18 joined together by an elongate support 20, which is substantially semi-circular in cross section. The container 22 is received on the elongate support 20 between the end caps 16 and 18 and houses the high viscosity composition to be dispensed. A drive rod 24 includes an ejector head (not shown) secured to the distal end thereof in any conventional manner, for driving material out of the container 22 and through dispensing nozzle 26. The dispensing nozzle can include a continuous extension of the container 22, in which case it is received within an elongate slot (not shown) in the end cap 16, in a conventional manner. Alternatively, the dispensing nozzle 26 can be formed as part of the end cap 16, in alignment with a dispensing opening provided in the end wall of the container 22 adjacent said end cap.

Still referring to FIG. 1, it should be understood that the drive rod 24 is moved to dispense the composition from the container 22 by actuation of a trigger 28 in a direction toward handle 30, as indicated by arrow 32 in FIG. 1. The trigger is spring loaded away from the handle 30 by a conventional torsional spring 33 (FIG. 3). Details relating to the manner in which the operation of the trigger 28 affects movement of the drive rod 24 will be described in detail later herein.

Figure 6:
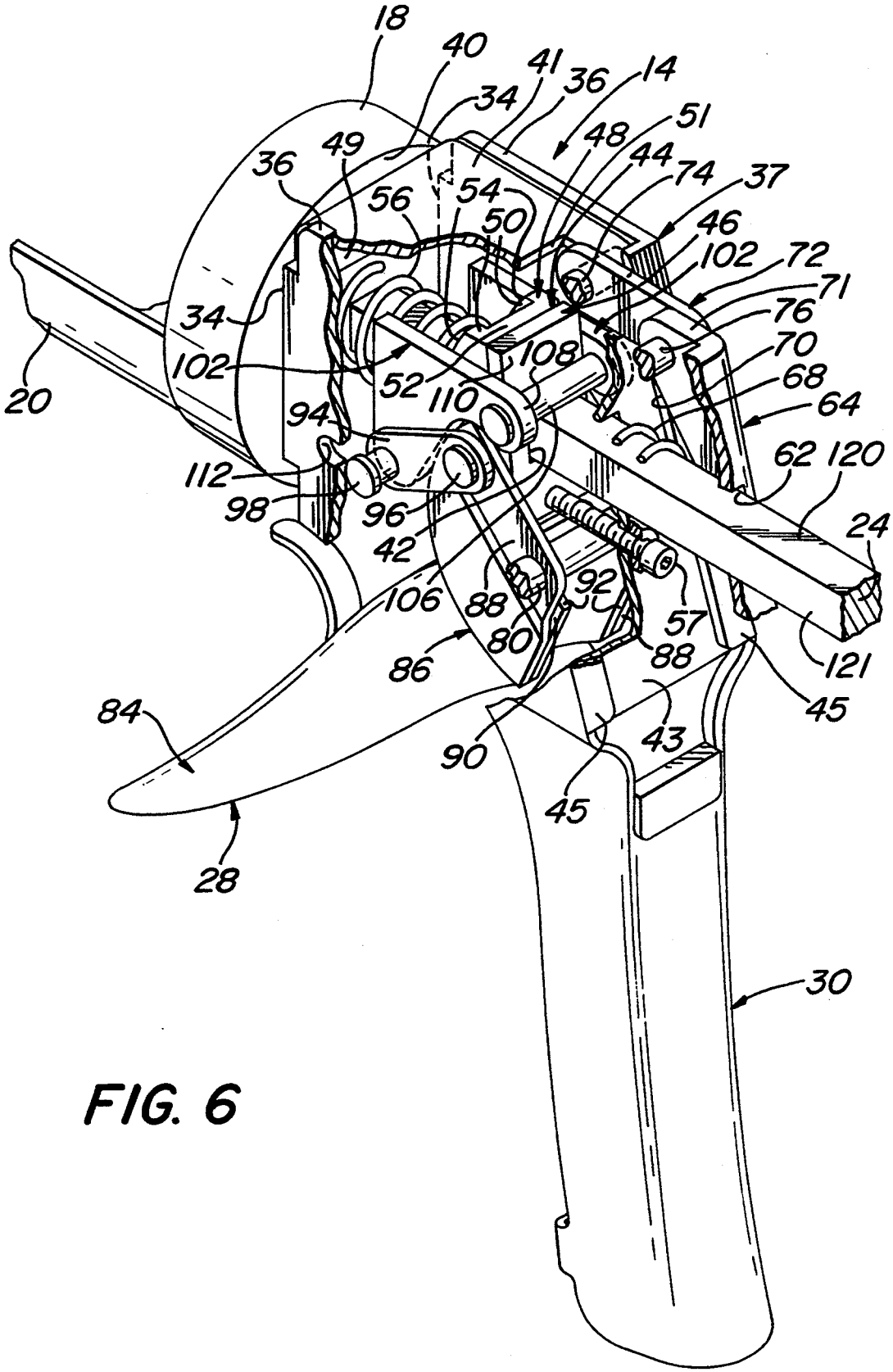
FIG. 6 is an enlarged fragmentary isometric view of the driving system of the device with parts broken away to show details of construct.

Referring specifically to FIGS. 2, 3 and 6, the end cap 18 is secured by welding to distal end surfaces 34 of substantially identical, transversely spaced-apart end plates 36. These end plates 36 constitute outer side walls of a housing 37 for the driving mechanism of the device 10, as will be described later herein.

The drive rod 24 chosen for illustration herein is a smooth-surfaced rod of a generally square cross-section, and this rod extends through a close-tolerance, generally square-shaped opening 38 in rear wall 40 of the cap 18, and into the container 22.

Referring specifically to FIGS. 5 and 6, the drive rod 24 extends through a close tolerance, square-shaped passage 42 in driving grip 44, and the driving grip is operated by the unique drive system of this invention to provide a high thrust driving force to the drive rod 24.

Referring specifically to FIGS. 2, 3, and 6, the driving grip 44 is of a conventional design including a pair of plates 46 and 48 which are separate from, but contiguous to each other. Distal plate 48 has transversely spaced-apart legs 50 extending forwardly of a base wall 52 and terminating in arcuate, forward surfaces 54. A compression spring 56 is located between and engages rear wall 40 of the end cap 18 and arcuate forward surfaces 54 of the spaced-apart legs 50 of the distal plate 48 of the driving grip 44. This compression spring 56 biases the driving grip 44 to the right as viewed in FIGS. 2 and 3. In order to assist in normally maintaining the driving grip 44 in a generally vertical orientation, as viewed in FIG. 3, prior to actuation of the driving grip to dispense fluid from the dispensing device, so that the drive rod 24 can be manually moved, or adjusted, axially relative to the grip, an adjustable leveling screw 57 is provided in a conventional manner.

Referring to FIGS. 3 and 6, the housing 37, in addition to including the side walls 36 includes a sheet metal plate forming a top wall 41 and back wall 43 of said housing. It should be noted that the back wall 43 of the housing is retained within inwardly directed flanges 45 of the side walls 36, with a downwardly facing ledge 47 adjacent lower end of the back wall resting on an upper surface 47' of the handle 30. It also should be noted that the top wall 41 terminates in a downwardly extending flange 49 that is biased against rear wall 40 of the cap 18. A generally rectangular cut-out 51, or opening, is provided in the sheet metal plate at the junction of the top wall 41 and back wall 43, to permit links 72 (to be described in detail hereinafter) to pass therethrough. In addition, side regions of the sheet metal plate adjacent the cut-out 51 are engaged, and supported, by transversely extending axle 74 (to be described in detail hereinafter).

Referring to FIGS. 2, 3, and 6, the drive rod 24 extends through a close tolerance square passage 58 in the rear wall 43 of the housing 37, and the adjustable leveling screw 57 is threaded into a passage 59 which also extends through said rear wall. The slotted head of the leveling screw 57 is aligned with a passage 61 extending through a rear dog 64 (to be described in detail hereinafter) to permit manual adjustment of the screw, as is desired or required.

Still referring to FIGS. 2, 3, and 6, the rod 24 also extends through a close-tolerance square passage 62 in the rear dog 64, and the rear dog has a finger-gripping extension 66 at the lower end thereof. A compression spring 68 is located between and in engagement with the rear wall 43 of the housing 37 and forward surfaces 70 of transversely spaced-apart side walls 71 of the rear dog 64. The rear dog 64 is pivoted adjacent its upper end thereof to a pair of transversely spaced-apart links 72. Each of the links 72 is pivotally joined at one end about the transversely extending axle 74 secured to inner surfaces of the end plates 36 and at its other end about an axle 76 joined between the side walls 71 of the dog 64.

It should be noted that the compression spring 68 biases the dog 64 in a counterclockwise direction as illustrated in FIG. 3 to cause edge surfaces of the passage 62 to dig into the drive rod 24 for precluding the drive rod from moving rearwardly (to the right in FIGS. 2 and 3) upon release of the trigger 28 after a dispensing stroke of said trigger. However, when it is desired to axially adjust the position of the drive rod 24 manually, the finger gripping extension 66 is manually depressed in the direction of arrow 67 to position the dog 64 in a generally vertical orientation to permit free sliding of the drive rod 24 within the passage 62 of said dog. It should be understood that the arrangement and manner of operation of the rear dog 64 is conventional and does not constitute a limitation on the present invention.

Referring to FIGS. 1, 3, 5 and 6, a unique, thrust-enhancing drive mechanism of this invention for acting on the driving grip 44 will now be described. Specifically, the trigger 28 is pivotally mounted between the end plates 36 by a bolt 80 secured to the end plates through a nut fastener 82. It should be understood that the pivot bolt could be replaced by a pivot pin or any other desired pivot support.

As can be seen best in FIGS. 3–5 and 6, the trigger 28 includes a hand grip section 84 and a first link section 86. The first link section 86 includes a pair of links 88 welded or otherwise secured to the outer surfaces 90 of transverse legs 92 of the hand grip section 84 of the trigger 28, to thereby move as a single unit with the hand grip section.

Referring to FIGS. 3–5 and 6, a separate toggle link 94 is secured at one end to each of the links 88 through a rivet 96 or other suitable fastener. The opposite end of each of the toggle links 94 is rotatably mounted on an elongate pivot shaft 98 adjacent opposed axial ends 100 of said shaft. The pivot shaft 98 is fixed to transversely spaced-apart, generally L-shaped force-transmitting plates 102 by extending through close-tolerance passages adjacent a free end 104 of one leg in each said plates. A force transmitting member in the form of a driving pin 106 is fixedly secured to each of the force-transmitting plates 102 adjacent free end 108 of the other leg thereof through a rivet connection, and this driving pin 106 rests on the upper surface 120 of the drive rod 24 and is disposed in contact with or closely adjacent to rear surface 110 of plate 46 of the driving grip 44.

It should be understood that the transversely spaced-apart plates 102 constitute force transmitting members for transmitting a high driving thrust from the interconnecting pivot shaft 98 to the driving pin 106. Specifically, the pivot shaft 98 constitutes an intermediate drive member having a high thrust imparted thereto by the movement of the toggle links 94 into an extended condition relative to the links 88 of the second link section 86. This high thrust is transmitted through the force transmitting plates 102 to the driving pin 106, which engages the rear or proximal end surface 110 of the driving grip 44 to thereby transmit the high thrust force to said driving grip.

Referring to FIGS. 1, 3, and 6, opposed axial ends 100 of the pivot shaft 98 extend through corresponding, adjacent slots 112 extending through each of the end plates 36. The slots 112 are identical in construction, and are elongate in a direction generally parallel to the direction of elongation of the drive rod 24. Thus, the cooperation of the elongate pivot shaft 98 with surfaces of the elongate slot 112 aids in controlling the movement of the toggle links 94 relative to the links 88 of the first link section 86 of the trigger 28. Specifically, prior to actuation of the trigger 28, the toggle links 94 are in a retracted condition relative to the pair of links 88 of the first link section 86, with the pivot shaft 98 ,(i.e., the intermediate drive member) being adjacent the proximal end of slots 112, as is illustrated in FIGS. 3 and 6.

Referring to FIG. 3, when the trigger 28 is actuated by manually pivoting it toward the handle 30, the links 94–88 are moved into a substantially linear orientation (the upper surface of links 88 being shown in phantom at 113), causing the pivot shaft 98 to move to the distal end of the slots 112 (not shown), to thereby move the transversely spaced-apart, generally L-shaped plates 102 in a forward direction a distance substantially equal to the length of elongation of the slots 112, to the position indicated in phantom representation in FIG. 3.

Referring specifically to FIGS. 3 and 5, it should be noted that the driving pin 106, prior to actuation of trigger 28, rests on upper surface 120 of the drive rod 24 and is in engagement with, or in very close proximity to, the rear surface 110 of the driving grip 44. Thus, the forward motion imparted to the driving grip 44 through the driving pin 106 by movement of the L-shaped plates 102 first cants the driving grip 44 in a counterclockwise direction, as viewed in FIG. 3, to cause surfaces adjacent the passage 42 extending through the said driving grip to dig into and engage substantially planar upper and lower surfaces 120, 121, respectively, of the drive rod 24. Thereafter the driving pin 106 moves the driving grip 44 and the rod 24 engaged thereby in a linear direction substantially the same distance as the pivot shaft 98 and the transversely spaced-apart plates 102 attached thereto.

It should be understood that the above-described, unique arrangement of elements permits the high thrust established through the toggle action of toggle links 94–88 to be transmitted from the intermediate drive member, in the form of elongate pivot shaft 98, to the force transmitting member, in the form of driving pin 106, through a force transmitting system including transversely spaced-apart force transmitting plates 102.

Figure 7:
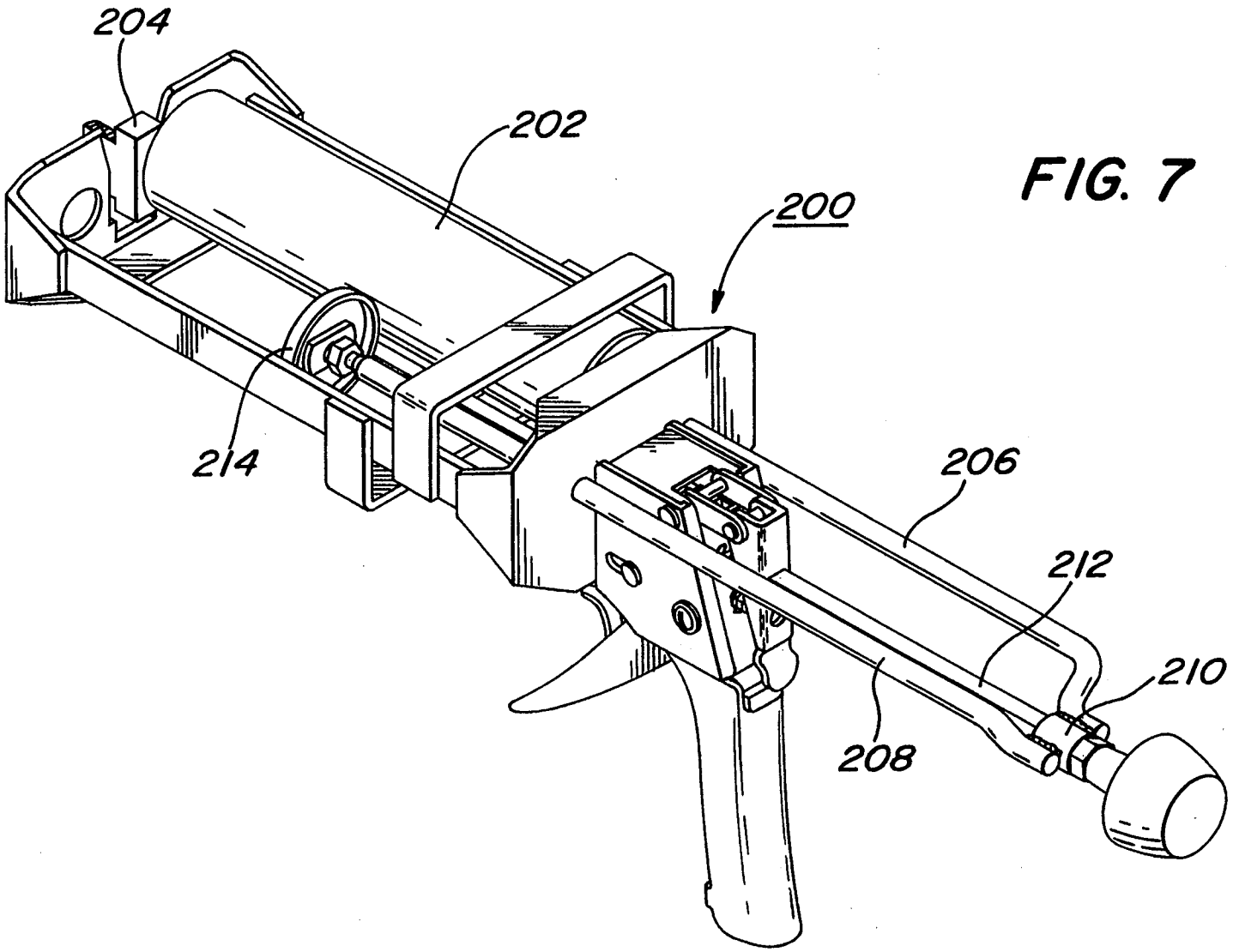
FIG. 7 is an isometric view of a multi-component dispensing device employing unique features of this invention.

Referring to FIG. 7, a dual cylinder dispenser employing the features of this invention is illustrated at 200. The dual system dispenser that is illustrated includes a pair of cylinders 202 (only one of which is shown) communicating at a downstream end thereof with a manifold chamber 204 for directing the materials within the two cylinders to a conventional nozzle or static mixer (not shown) attached to the downstream end of the manifold chamber 204.

As can be seen in FIG. 7, the device 200 includes two piston rods 206, 208 which are welded to a ferrule 210 secured at the proximal end of a drive rod 212. Each of the piston rods 206, 208 includes an ejector head 214 at the distal end thereof (only one of which is illustrated).

The drive rod 212, unlike the drive rod 24 of the dispensing device 10, does not include an ejector head at the distal end thereof because in this embodiment of the invention the drive rod 212 is employed to drive separate piston rods 206, 208, which, in turn, include ejector heads 214 thereon for dispensing high viscosity materials from the two cylinders 200. However, it should be understood that the drive rod 212 is driven through the same cooperation of elements employed to drive the drive rod 24, as was described in detail in connection with the device 10, and therefore that discussion will not be repeated herein. It should be understood that the embodiment shown in FIG. 7 is presented herein for purposes of completeness, to show that the features of this invention can be employed in a dual component dispensing device, as well as in a single component dispensing device.

A number of variations can be employed in accordance with the broadest aspects of this invention. For example, and not by way of limitation, the smooth-surfaced drive rod 24 can be of a variety of cross-sectional configurations other than square (e.g., round, oval, etc), with the various openings through which the rod pass being close-tolerance openings of substantially the same shape as the cross-sectional configuration of the drive rod. In addition, and also not by way of limitation, the housing 37 can be formed in a variety of ways, and need not be a fully enclosed structure. For example, the rear wall 43 of the housing could be formed by an extension of the rear wall of the handle 30, and a top wall for the housing can be omitted.

Without further elaboration, the foregoing will so fully illustrate this invention that others may, by applying current or future knowledge, readily adapt the same for use under various conditions of service.

What is claim is:

1. A dispensing device for high viscosity compositions, said device including:

a. an elongate drive rod movable in a linear direction for dispensing a high viscosity composition;

b. a driving grip for engaging the drive rod and moving said drive rod in the linear direction, said driving grip including a passage therethrough and said elongate drive rod extending through said passage in close conformity with surfaces defining said passage;

c. a trigger pivotally secured to an axle and including a hand gripping section for actuating the trigger and a first link section, said hand gripping section and the first link section being integrally joined to move as a single unit about said axle;

d. a second link pivotally secured to said first link section of the trigger through a toggle axle spaced from the axle of the trigger, said second link and said first link section being movable from a first, retracted condition prior to manual actuation of the trigger to a second, extended condition upon manual actuation of the trigger to provide a high thrust to the second link;

e. a force transmitting member engaging the driving grip; and f. means operably connecting the second link to the force transmitting member for imparting the high thrust from the second link to the force transmitting member and to the driving grip engaged by said force transmitting member.

2. The dispensing device of claim 1, wherein the means for operably connecting the second link to the force transmitting member includes an intermediate drive member fixed to the second link and spaced from the toggle axle, said intermediate drive member being operably connected to a force transmitting system for transmitting the high thrust driving force from the intermediate drive member to the force transmitting member engaging the driving grip, said force transmitting system including a rigid force transmitting means fixed to both said intermediate drive member and said force transmitting member.

3. The dispensing device of claim 1, wherein said elongate drive rod includes a substantially smooth surface engageable by the driving grip for advancing the drive rod in the linear direction for dispensing the composition.

4. The dispensing device of claim 2, wherein said drive rod includes a distal end on the distal side of the driving grip adjacent the composition to be dispensed and a proximal end on the opposite, proximal side of the driving grip, said intermediate drive member being located on the distal side of the driving grip and the force transmitting drive member being located on the proximal side of the driving grip.

5. The dispensing device of claim 2, wherein said intermediate drive member is an elongate rod extending transversely to the elongate direction of the drive rod and including opposed ends constrained for movement within elongate slots of transversely spaced-apart side support walls, said direction of elongation of the slots being substantially parallel to the elongate direction of the drive rod, said intermediate drive member being movable within said elongate slots when the second link and the first link section move relative to each other between the retracted and extended conditions.

6. The dispensing device of claim 2, wherein said intermediate drive member is located below the drive rod and said force transmitting member is located above said drive rod.

7. The dispensing device of claim 2, wherein said force transmitting member is an elongate rod extending transversely to the elongate direction of the drive rod.

8. The dispensing device of claim 2, wherein said force transmitting means includes transversely spaced-apart, rigid plate members, said intermediate drive member and said force transmitting member being secured to said transversely spaced-apart plate members to move as a unit therewith.

9. The dispensing device of claim 8, wherein said intermediate drive member is an elongate rod extending transversely to the elongate direction of the drive rod and being secured to the spaced-apart, rigid plate members, said intermediate drive member including opposed ends constrained for movement within elongate slots of transversely spaced-apart side support walls, each of said side support walls being adjacent a respect rigid plate member and said direction of elongation of the slots being substantially parallel to the elongate direction of the drive rod, said intermediate drive member being movable within said elongate slots when the second link and the first link section move relative to each other between the retracted and extended conditions thereof.

10. The dispensing device of claim 8, wherein said intermediate drive member is located below the drive rod and said force transmitting member is located above said drive rod.

11. The dispensing device of claim 8, wherein said force transmitting member is an elongate rod extending transversely to the elongate direction of the drive rod and secured to the transversely spaced-apart plate members.

12. The dispensing device of claim 9, wherein said intermediate drive member is located below the drive rod and said force transmitting member is located above said drive rod.

13. The dispensing device of claim 9, wherein said force transmitting member is an elongate rod extending transversely to the elongate direction of the drive rod and secured to the transversely spaced-apart plate members.

* * * * *